United States Patent [19]

Kruger

[11] Patent Number: 4,742,802

[45] Date of Patent: May 10, 1988

[54] ROTARY VALVE FOR CONTROL OF THE CYLINDER CHARGE CHANGE OF AN INTERNAL COMBUSTION ENGINE

[75] Inventor: Hermann Kruger, Wolfsburg, Fed. Rep. of Germany

[73] Assignee: Volkswagen AG, Wolfsburg, Fed. Rep. of Germany

[21] Appl. No.: 86,106

[22] Filed: Aug. 14, 1987

[30] Foreign Application Priority Data

Sep. 3, 1986 [DE] Fed. Rep. of Germany ..... 3629970

[51] Int. Cl.[4] ..... F01L 7/00

[52] U.S. Cl. ..... 123/190 A; 123/190 R

[58] Field of Search ..... 123/190 R, 190 A

[56] References Cited

U.S. PATENT DOCUMENTS 2,940,432 6/1960 Hijszeller ..... 123/190 R 4,562,796 1/1986 Eickmann ..... 123/190 A

FOREIGN PATENT DOCUMENTS 53613 3/1983 Japan ..... 123/190 R

*Primary Examiner*—E. Rollins Cross

*Attorney, Agent, or Firm*—Brumbaugh, Graves, Donohue & Raymond

[57] ABSTRACT

In order to reduce the required diameter of a rotary valve, there are combined in one cross section, also containing a housing-side fresh gas and, respectively, exhaust gas opening, fresh gas and, respectively, exhaust gas ducts leading to adjacent combustion chambers, so as to form a common conduit extending in the plane of the fresh gas and, respectively, exhaust gas opening.

5 Claims, 1 Drawing Sheet

ROTARY VALVE FOR CONTROL OF THE CYLINDER CHARGE CHANGE OF AN INTERNAL COMBUSTION ENGINE

BACKGROUND OF THE INVENTION

The invention concerns a rotary valve for controlling the cylinder charge change of an internal combustion engine having a plurality of combustion chambers. Two fresh gas or exhaust gas ducts associated in each case with adjacent combustion chambers extend as regards their region in a cross-sectional zone of the rotary valve. The engine also contains a common fresh gas or exhaust gas opening in the rotary valve housing.

In the case of a cylindrical slide valve having a construction known from DE-OS No. 3,241,723, the exhaust gas ducts of the two combustion chambers (cylinders) which are adjacent in each case are arranged, with a view to limit the length of the rotary valve in the direction of its axis which coincides with its axis of rotation, in such a manner that their points of opening which face the common exhaust gas opening in communication with a conventional exhaust gas system are offset angularly over the periphery of the rotary valve, i.e., they are located in a common cross-sectional plane also containing the exhaust gas opening. The points of confluence which serve as a connection between the two exhaust gas ducts and the cylinder concerned, however, are offset on the rotary periphery both in the peripheral and in the axial directions, the axial offset being determined, among others, by the axial separation of the cylinders. The common cross-sectional region and, respectively, the common cross-sectional plane practically coincide with the plane of separation between the two adjacent cylinders.

In accordance with this state of the art, the exhaust gas ducts associated with adjacent cylinders are thus located next to each other as regards their placement in the aforementioned cross-sectional plane. While this offers advantages in that it results in a relatively short rotary valve, the course of the ducts in the cross-sectional plane next to one another necessitates a relatively large diameter of the cylindrical rotary valve in that otherwise, the duct regions arranged with angular offset within one cross-sectional region cannot be provided with sufficiently large flow cross sections.

SUMMARY OF THE INVENTION

Accordingly, it is an object of the invention to provide a rotary slide valve of the above discussed type with a smaller diameter.

Pursuant to this object, and others which will become apparent hereafter, one aspect of the present invention resides in a rotary valve wherein two fresh gas or exhaust gas ducts in the region of the axis of rotation of the rotary valve converge into a common conduit which extends in the common cross-sectional zone. The conduit is arranged so that at predefined angular positions of the rotary valve the conduit is in communication with the common fresh gas and, respectively, exhaust gas opening.

In a further embodiment of the invention the common conduit extends with an angular shape so that it opens at two points of the rotary valve periphery located in the cross-sectional plane also containing the fresh gas and, respectively, exhaust gas opening.

Still another embodiment the common conduit in the cross-sectional plane also containing the fresh gas and, respectively, exhaust gas opening, is enlarged in a funnel shape in a direction towards the rotary valve periphery.

One advantage of the invention may be found in the fact that it solves the problem defined by utilizing the simplest means, namely, by partial combination of the heretofore separated exhaust gas and fresh gas ducts of adjacent cylinders. Thereby the common conduit in accordance with one embodiment of the invention may contain as before, due to angular construction, two individual mouth points on the rotary valve periphery which only at defined angular positions of the rotary valve are located below the exhaust gas and, respectively, fresh gas opening in the rotary valve housing, or otherwise, according to another embodiment, only one single mouth point of this joint conduit is provided which is sufficiently large so that the limitation in time of the flow connection between the fresh gas and, respectively, the exhaust gas opening, on the one hand, and the cylinder concerned, on the other hand, is determined solely by the positions of the mouth points of the two individual exhaust gas and, respectively, fresh gas ducts on the rotary valve periphery. The mouth points are in communication with exhaust gas and, respectively, fresh gas bores in the cylinder head leading to the cylinders.

DETAILED DESCRIPTION OF THE PREFERRED EMBODIMENTS

In the examples of embodiments it is assumed that the ducts concerned are exhaust gas ducts of adjacent cylinders, not shown. A corresponding construction, however, could also be utilized for the fresh gas ducts of the adjacent cylinders.

Figure 1:
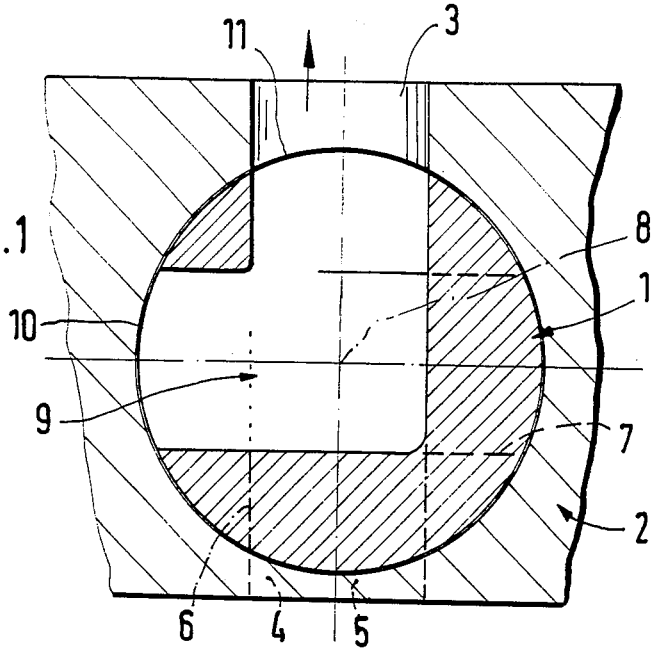
FIG. 1 illustrates a first embodiment of a rotary valve pursuant to the present invention.

Viewing FIG. 1, we find that the cylindrical rotary valve is designated in general by -1- and its housing by -2-. Represented is a sectional plane which extends approximately along the plane of separation between two adjacent cylinders, such as is also true for the plane containing the common exhaust gas opening in the rotary valve housing as per the aforementioned DE-OS No. 3,241,723.

The rotary valve housing -2- contains in the plane the exhaust gas opening -3- to which is joined an exhaust gas system, known in itself and therefore not represented, of the internal combustion engine. The direction of flow is indicated by the arrow.

Ahead of and, respectively, behind this common cross-sectional plane the housing -2- contains two exhaust gas bores -4- and -5-, respectively, which are congruent in the axial direction so that in FIG. 1, they cannot be discerned separately. The exhaust gas bore -4- ahead of the plane of the drawing and thus of the common cross-sectional plane leads to a cylinder in front, relative to the drawing, while the exhaust gas bore -5- behind, leads to a cylinder behind the drawing plane. Correspondingly, the cylindrical rotary valve -1- also contains two exhaust gas ducts -6- and -7- of which duct -6- ahead of the drawing plane communicates precisely with the exhaust gas bore -4- whereas the exhaust gas duct -7- communicates with the exhaust gas bore -5-associated with it only following clockwise rotation of the rotary valve -1- by 90°.

The two individual exhaust gas ducts -6- and -7- converge in the region of the axis of rotation -8- of the cylindrical rotary valve -1- so that both contain the common conduit -9- which in case of a four-cylinder four-stroke engine forms an angle of 90° whose peak is placed on the axis -8-. The common conduit -9- has two mouth points -10- and -11- on the periphery of the rotary valve -1- of which the mouth point -11- is placed directly below the exhaust gas opening -3- in the housing -2-, so that the conduit arrangement produces a connection of the flow between the cylinder which is the front cylinder in the figure, via the exhaust gas opening -4-, the exhaust gas duct -6-, the common conduit -9- and the mouth point -11- whereas following swivelling of the rotary valve by 90°, the cylinder which is the rear cylinder in the figure is in flow connection with the exhaust gas opening -3- via the exhaust gas bore -5-, the individual exhaust gas duct -7-, the common conduit -9- and the mouth point -10-.

Figure 2:
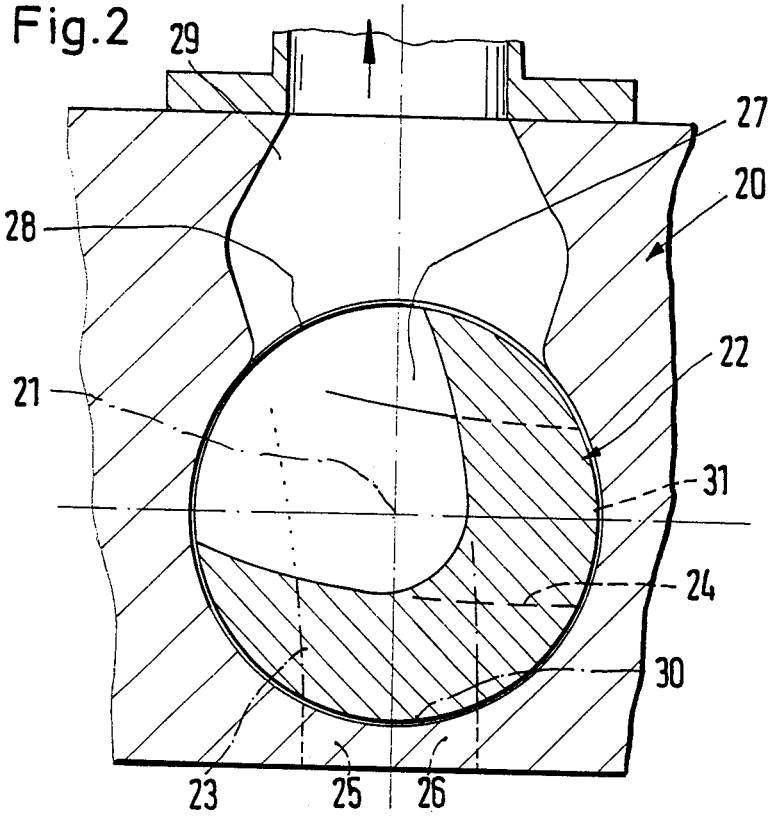
FIG. 2 is a view similar to that in FIG. 1 of a second embodiment of the present invention.

In the embodiment shown in FIG. 2, the cylindrical rotary valve -22- which again rotates in a housing -20- around an axis -21- contains likewise two individual ducts - 23- and -24-, analogous to the ducts -6- and -7- in FIG. 1, which, depending on the angular position of the rotary valve -22- communicate with an individual exhaust bore -25- (ahead of the drawing plane) or -26- (behind the drawing plane). However, the exhaust gas ducts -23- and -24- pass into a common conduit -27- which is not angular but expands in the manner of a funnel in the direction towards its sole mouth point -28-. The exhaust gas opening -29- in the housing -20- is also larger in the cross-sectional plane viewed than it is in FIG. 1.

Thus, in this embodiment no interruption occurs in the connection between the common conduit -27- and the exhaust gas opening -29- due to the period of time and, respectively, the region of the angular rotation between the two exhaust gas ducts -23- and -24-. The suspension of the flow in the common conduit -27- is determined solely by the prevailing position of the mouth points -30- and -31- of the individual exhaust gas ducts -23- and -24- on the rotary valve periphery.

A common feature of all the embodiments is the avoidance of duct regions extending next to one another in the common cross-sectional region, so that without any reduction in the flow cross section relative to the state of the art, a considerable reduction of the rotary valve diameter required is achieved. This constitutes a special advantage in that a reduction in the diameter of the rotary valve leads to a reduction in the sliding speed of the rotary valve seals and thereby to diminished friction, heating, wear and tear and driving torque of the rotary valve. This, in turn, results in the advantageous possibility to reduce the gap volume between the rotary valve and the housing and to render the heat transmission surfaces in the ducts and conduits smaller.

While the invention has been illustrated and described as embodied in a rotary valve for control of the cylinder charge change of an internal combustion engine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by letters patent is set forth in the appended claims:

1. A rotary valve for controlling a cylinder charge change of an internal combustion engine containing a plurality of combustion chambers, the rotary valve comprising: two gas ducts provided so as to be associated with adjacent combustion chambers and so as to extend in a common cross-sectional zone of the rotary valve; and a rotary valve housing having a common gas opening located in said common cross-sectional zone, said two gas ducts being further provided so as to converge in the region of an axis of rotation of the rotary valve into a single common conduit extending in the common cross-sectional zone, the rotary valve having predefined angular positions in which said single conduit is in communication with the common gas opening.

2. A rotary valve as defined in claim 1, wherein said common conduit extends with an angular shape so as to open at two points of the rotary valve periphery located in a cross-sectional plane which also contains the gas opening.

3. A rotary valve as defined in claim 1, wherein said common conduit is in a cross-sectional plane which contains the gas opening, and is enlarged in a funnel shape in a direction towards the rotary valve periphery.

4. A rotary valve as defined in claim 1, wherein said gas ducts are fresh gas ducts, and said common gas opening is a common fresh gas opening.

5. A rotary valve as defined in claim 1, wherein said gas ducts are exhaust gas ducts, and said common gas opening is an exhaust gas opening.

* * * * *